US010010173B1

(12) United States Patent
Ricco

(10) Patent No.: US 10,010,173 B1
(45) Date of Patent: Jul. 3, 2018

(54) DART STORAGE RACK

(71) Applicant: Mike Ricco, Newbury, OH (US)

(72) Inventor: Mike Ricco, Newbury, OH (US)

( * ) Notice: Subject to any disclaimer, the term of this patent is extended or adjusted under 35 U.S.C. 154(b) by 0 days.

(21) Appl. No.: 15/471,030

(22) Filed: Mar. 28, 2017

(51) Int. Cl.
*A47B 23/04* (2006.01)
*A47F 7/00* (2006.01)
*A47B 81/00* (2006.01)
*A47F 5/08* (2006.01)

(52) U.S. Cl.
CPC ..... *A47B 81/005* (2013.01); *A47F 5/08* (2013.01); *A47F 7/0021* (2013.01); *A47G 2200/00* (2013.01); *Y10S 211/01* (2013.01)

(58) Field of Classification Search
CPC ..... A47B 81/005; A47F 5/08; A47F 5/0884; A47F 7/0021; A47F 7/0028; A47F 5/10; B43M 99/004; A47G 2200/10; A47G 1/17; A47G 2200/106; Y10S 211/01
USPC ..... 211/85.7, DIG. 1, 2, 87.01, 60.1; 248/683, 206.5, 309.4, 350; 220/483; 206/818
See application file for complete search history.

(56) References Cited

U.S. PATENT DOCUMENTS 2,346,582 A * 4/1944 Insler ..... G03B 27/6214 211/DIG. 1
2,414,653 A * 1/1947 Lookholder ..... A47K 1/09 15/220.2
2,965,235 A * 12/1960 Daline ..... A47F 5/0823 211/1
3,776,387 A * 12/1973 Brent ..... A61B 50/20 211/70.5
3,827,021 A * 7/1974 Phelon ..... A47J 47/16 248/309.4
4,294,365 A * 10/1981 Henderson ..... F42B 39/007 206/315.1
D262,465 S * 12/1981 Henderson ..... D21/385
4,451,810 A * 5/1984 Miller ..... H01F 7/0215 248/206.5
4,586,616 A * 5/1986 Cooper ..... A47J 47/16 211/88.04
5,163,566 A * 11/1992 Hempel ..... A47K 1/09 211/65
5,301,822 A * 4/1994 Coleman ..... B25H 3/04 211/70.6
5,306,467 A * 4/1994 Douglas-Hamilton ... B01L 9/50 211/DIG. 1
5,560,617 A * 10/1996 Liang ..... F41J 5/14 273/371
5,921,405 A * 7/1999 Dumas ..... G11B 33/0483 211/40
6,073,931 A * 6/2000 Voden ..... F41J 3/0028 273/404
6,216,888 B1 * 4/2001 Chien ..... B23Q 3/1546 211/70.6

(Continued)

*Primary Examiner* — Jennifer Eleanore Novosad
(74) *Attorney, Agent, or Firm* — Daniel M. Cohn; Howard M. Cohn

(57) ABSTRACT

A dart storage rack to securely store darts when not in use. The dart storage rack includes a base member adapted to be secured to a wall, such that the base member is formed of four side walls, a top wall, and a bottom wall. The top wall contains one or more dart storage holes to accommodate a metal point of a the dart. The bottom wall contains one or more dart storage magnets to allow for a secondary storage of the darts.

9 Claims, 2 Drawing Sheets

(56) References Cited

U.S. PATENT DOCUMENTS

| | | | | |
|---|---|---|---|---|
| 6,811,127 | B1 * | 11/2004 | Shiao | B25H 3/04 211/70.6 |
| 7,735,645 | B2 * | 6/2010 | Joyce | B25H 3/003 206/350 |
| 7,971,736 | B1 * | 7/2011 | Stewart | B25H 3/04 211/70.7 |
| 7,997,024 | B2 * | 8/2011 | Gesik | A01K 97/06 43/54.1 |
| 8,499,943 | B1 * | 8/2013 | Neldner | A47J 45/02 206/818 |
| 8,727,141 | B2 * | 5/2014 | Akalin | A47K 1/09 211/66 |
| 9,314,315 | B2 * | 4/2016 | Wong | A61C 3/04 |
| 2002/0175131 | A1 * | 11/2002 | Johnson | A47G 21/14 211/70.7 |
| 2004/0007548 | A1 * | 1/2004 | Tilly | A47B 77/16 211/74 |
| 2008/0169210 | A1 * | 7/2008 | Heidenreich | A63B 55/408 206/315.2 |
| 2009/0078661 | A1 * | 3/2009 | Kinsella | A47B 81/005 211/64 |
| 2012/0043348 | A1 * | 2/2012 | Sunatori | B65D 51/242 222/142.3 |
| 2014/0033602 | A1 * | 2/2014 | Gesik | A01K 97/06 43/57.1 |

* cited by examiner

DART STORAGE RACK

FIELD OF INVENTION

The present invention relates to an improved darts holder and in particular, a dart storage rack to securely store darts when not in use.

BACKGROUND OF THE INVENTION

Dart throwing is an old and familiar form of recreation and is increasing in popularity among more serious players in contests or tournaments. A conventional playing dart has an elongated sharp needle-like nose called the point connected to a properly weighted stem or hand grip portion called the body with feathers or plastic vanes similar to fletching on an arrow and referred to as the flight on the shaft near the rear of the dart for flight stabilization. Such darts are thrown at a relatively soft wood or fiber target board with various scoring sectors marked thereon and with several players taking turns throwing. The conventional, modern dart game employs a board which is separated by radial extending rays and circumferential rings. The scoring areas thus defined have different score values, with numerical score values circularly marked around the scoring areas, and with the circumferential rings separating the score areas into score multiple values.

There are various dart games one can play by standing at a predetermined distance from the board and then throwing the darts. The board has different sections marked out with numbers and colors. Each player has three darts to throw and the total combined score of the three darts of each player is kept. The first person to reach the chosen game point total wins the game. While waiting a turn, players are somewhat inhibited in other activities because they need to either hold their darts or attempt to find a temporary storage location for their darts.

SUMMARY OF THE INVENTION

According to another embodiment of the present invention, there is disclosed a dart storage rack to securely store darts when not in use. The dart storage rack includes a base member adapted to be secured to a wall, such that the base member is formed of four side walls, a top wall, and a bottom wall. The top wall contains one or more dart storage holes to accommodate a metal point of a the dart. The bottom wall contains one or more dart storage magnets to allow for a secondary storage of the darts.

According to another embodiment of the present invention, there is disclosed a dart storage rack to securely store darts when not in use. The dart storage rack includes a base member adapted to be secured to a wall, such that the base member is formed of four side walls, a top wall, and a bottom wall. The bottom wall contains one or more dart storage magnets to allow for a storage of the darts.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

Figure 1:
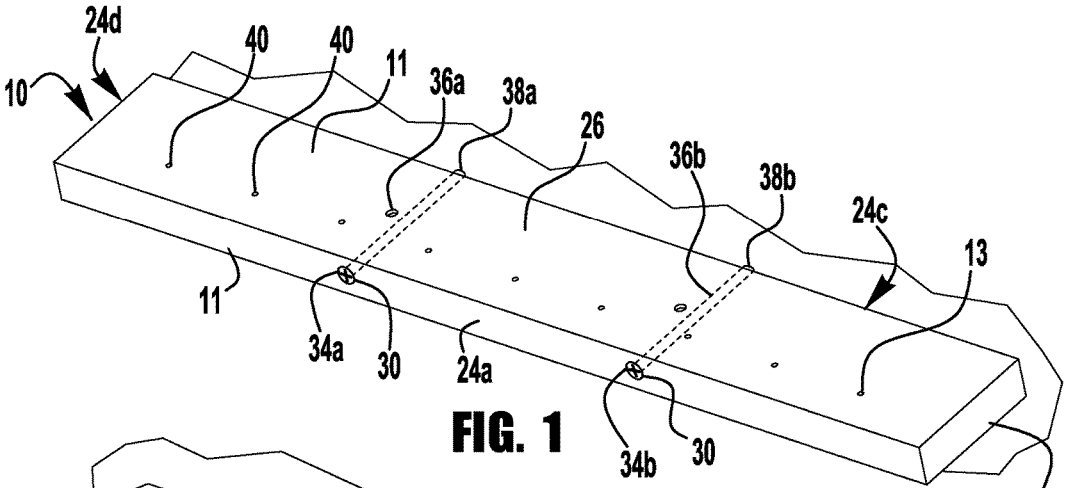

These and other objects of the present invention will become apparent, particularly when taken in light of the following illustrations wherein:

FIG. 1 is a front three-dimensional view of the darts storage rack, in accordance with the present invention.

Figure 2:
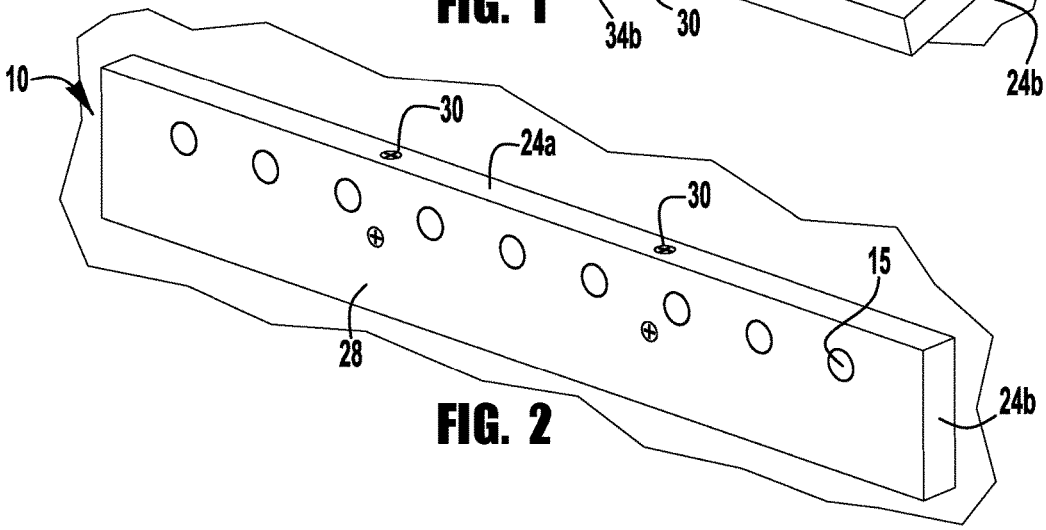

FIG. 2 is a bottom three-dimensional view of the darts storage rack, in accordance with the present invention.

Figure 3:
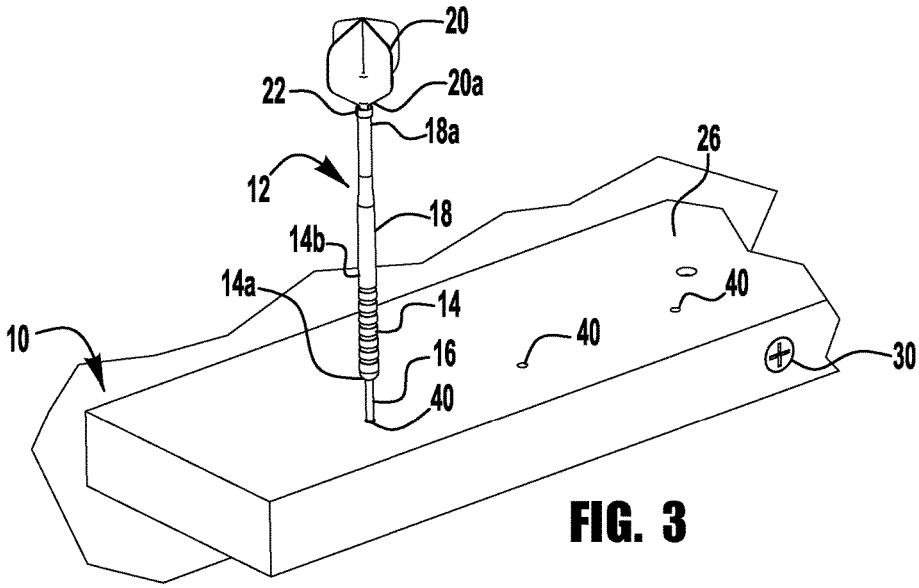

FIG. 3 is a top three-dimensional view of the darts storage rack housing a dart, in accordance with the present invention.

Figure 4:
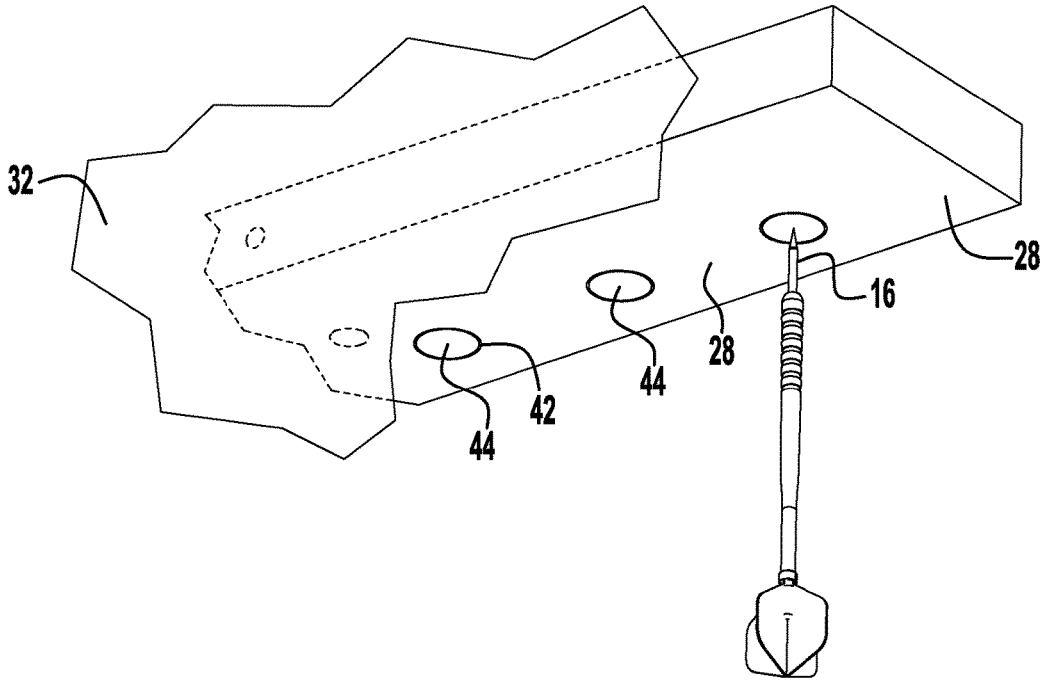

FIG. 4 is a bottom three-dimensional view of the darts storage rack housing a dart, in accordance with the present invention.

Figure 5:
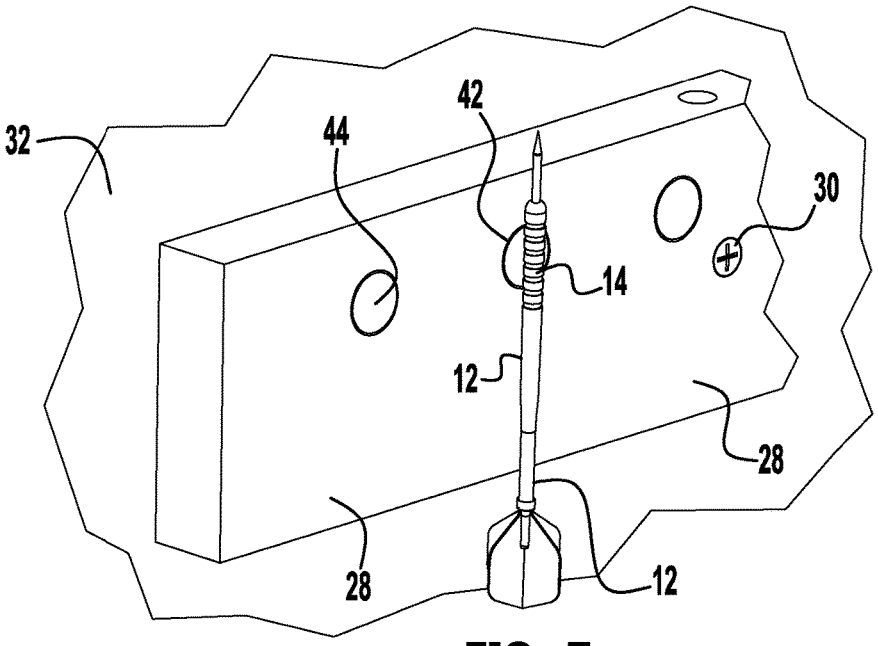

FIG. 5 is a side three-dimensional view of the darts storage rack housing a dart in an alternative arrangement, in accordance with the present invention.

DETAILED DESCRIPTION OF THE INVENTION

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

The problem of storage for darts 12 when not in use is admittedly not complex but this problem has persistently existed, especially in homes and patios. Danger of injury by the sharp spike tips of the darts has compounded the problem when the darts are merely left in the last played position on the dart board since some of the darts will tend to loosen and fall after a time. A trough on the dart board assembly, if available, will provide only a haphazard and untidy storage. In fact, any storage means involving laying the darts to rest horizontally for extended periods will result in certain minor but functionally important deformation of the flights or vanes of the darts when the darts are re-used. Any such horizontal storage is likely to be detrimental to the dart, leading to misplacement and/or loss and damage to the darts especially when the darts fall to the floor.

As seen in FIG. 1, the dart storage rack 10 is designed to safely and securely store darts when not in use. The storage rack 10 prevents danger of injury to others from the sharp dart tips. It allows for easy access to the darts, as well as an aesthetically pleasing manner of displaying the darts. In general terms, the dart storage rack 10 provides a base member 11 designed to be secured to wall, typically in the vicinity of a dart board. The base member 11 has a series of openings 13 and magnets 15, to accommodate a plurality of darts 12.

The dart storage rack 10 is designed to accommodate one or more darts for use with a dart board. A conventional dart 12, as seen in FIG. 3, is comprised of a barrel 14, typically made of brass or other metal, a metal point 16 attached to the front end 14*a* of the barrel, a shaft 18 which can be made of plastic or metal connected to the rearward end 14*b* of the barrel and a flight 20 mounted at the rearward end 18*a* of the shaft. The flight 20 is typically made of plastic or reinforced fabric. The rearward end 18*a* of the shaft 18 is typically divided into four prongs by an X-shaped slot 22. The flight 20 is mounted on the shaft 18 by inserting the forward end 20*a* of the flight into the slot 22.

FIG. 1 illustrates a front view of the dart storage rack 10. The base member 11 of the dart storage rack 10 may be constructed of any desired shape, such as being elongated with a rectangular shape. Further, the base member 11 can be constructed of various woods or molded with plastics. The base member 11 is formed of four side walls 24*a*, 24*b*, 24*c*, and 24*d* (24*a*-24*d*), a top wall 26, and a bottom wall 28. The storage rack 10 can be of any desired dimensions, such as a width with a range between 1 inches and 6 inches, a length with a range between 3 inches and 12 inches, and a height with a range between 1 inches and 6 inches.

The dart storage rack 10 cantilevers from a wall 32, and is attached in any desired fashion, such as via one or more screws 30. In this embodiment, the screws 30 extend through first openings 34*a* and 34*b* within side wall 24*a* of the housing member 11, then through channels 36*a* and 36*b* which extend through the housing member, and finally out through second openings 38*a* and 38*b* within side wall 24*c*. The screws 30 passing therethrough securely fasten the dart storage rack 10 to the wall 32.

The top wall 26 contains one or more dart storage holes 40 to allow for storage of a plurality of darts 12, as seen in FIG. 3. The one or more dart storage holes 40 are preferably spaced at a range between 0.5 inches and 3 inches from each other. Each of the one or more storage holes 40 has a circumference suitable to accommodate the metal point 16 of a dart 12. The storage holes 40 are cylindrical and do not extend completely through the housing member 11. Rather, the storage holes 40 extend into the housing member 11 with a length in range between 0.25 inches and 4 inches.

The metal point 16 of a dart 12 is designed to be temporarily inserted into a storage hole 40, thereby temporarily securing the dart in place when not in use. Ideally, the length of the storage holes 40 are sufficient to secure a significant portion of the metal point 16 to properly secure the dart 12. It is within the terms of the embodiment that the storage holes 40 be drilled at an angle to allow the darts 12 to project outwardly, allowing the player to reach for them rather easily.

It is within the terms of the embodiment that there be an area within the dart storage rack 10 to store small accessories that are needed for the game of darts. For example, there may be a recessed cut-out (not shown) within the a top wall 26 that may be used for storing chalk that is needed to keep score, a dart wrench which performs many different functions to make repairs to damaged darts, a dart sharpener for dart tips after long periods of use and a chalk board eraser to wipe clean the chalk board after every game.

FIG. 2 is a bottom view of the base member 11 illustrating the bottom wall 28. The bottom wall 28 provides an alternative storage location for darts 12, as seen in FIG. 2 and FIG. 4. The bottom wall 28 contains one or more dart storage magnets 44 to allow for a secondary storage of a plurality of darts 12, as seen in FIG. 3. Each of the one or more dart storage magnets 44 is disposed within an accommodating aperture 42 disposed within the bottom wall 28. The storage magnets 44 are preferably permanently secured within the apertures 42, such as with an adhesive or simply tension fit. The apertures 42 do not extend completely through the housing member 11. Rather, the apertures 42 extend into the housing member 11 with a preferred length in range between 0.25 inches and 3 inches. The dart storage magnets 44 and accommodating apertures 42 are typically cylindrical, although any shape may be utilized. Each of the storage magnets 44 has a circumference with a preferred range between 0.01 inches and 3 inches.

The one or more dart storage magnets 44 are preferably spaced at a range between 0.25 inches and 4 inches from each other. The storage magnets 44 are designed to temporarily secure the metal point 16 of a dart 12, as illustrated in FIG. 4. The metal point 16 has a magnetic attraction to the storage magnet 44, and remains in place until removed by the user.

It should noted that the dart storage magnets 44 and the storage holes 40 do not interfere with each other. Therefore, the user may simultaneously store darts 12 within the storage holes 40 disposed within the top wall 26, while also securing darts to the storage magnets 44 disposed within the bottom wall 28.

FIG. 5 illustrates an alternative storage arrangement of the dart storage rack 10. In this positioning, the base member 11 is sited such that the bottom wall 28 is parallel to the wall 32. Screws 30 are used to secure the dart storage rack 10 to the wall 32. The dart storage magnets 44 temporarily secure the barrel 14 of the darts 12. In this embodiment, the storage holes 40 may not be used in conjunction with the storage magnets 44.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A dart storage rack, comprising:

one or more darts each formed of a barrel having a front end and a rear end, a metal elongated sharp needle-like nose having a first end and second end with the second end of the needle-like nose attached to the front end of the barrel, a shaft connected at a first end to the rear end of the barrel and a flight connected to a second end of the shaft, whereby a length is defined between the front end of the barrel and the second end of the shaft;

a base member formed of a front wall, a rear wall, two side walls, a top wall, and a bottom wall, whereby a length is defined between the two side walls and a width is defined between the front and rear walls;

the top wall containing one or more dart storage holes that are each cylindrical in shape and that do not extend completely through the base member, and the bottom wall containing one or more apertures that do not extend completely through the base member, and one or more dart storage magnets each inserted within the one or more apertures;

wherein the base member is adapted to be disposed in both a first position and a second position, whereby when the base member is disposed in the first position, the rear wall is adapted to be attached to a substantially vertical surface such that the one or more darts are supported by the one or more dart storage holes such that each of the elongated sharp needle-like nose is inserted into a respective dart storage hole and the flight is located above the nose, and the one or more darts are supported by the one or more dart storage magnets such that the metal elongated sharp needle-like nose is attracted to the magnet and the flight is located below the nose, thereby allowing the length of the respective dart to extend perpendicular to the length of the base member; and whereby when the base member is disposed in the second position, the top wall is adapted to be attached to the substantially vertical surface such that the barrel of the one or more darts is attracted to the respective magnet, thereby allowing the length of the dart to extend parallel to the width of the base member.

2. The dart storage rack of claim 1 further including the base member being elongated with a rectangular shape.

3. The dart storage rack of claim 1 further including the base member cantilevering from the vertical surface when in the first position.

4. The dart storage rack of claim 3 further including the base member attached to the vertical surface via one or more screws.

5. The dart storage rack of claim 4 further including the screws extending through first openings within the front and rear walls when the base member is in the first position or through second openings extending through the top and bottom walls when the base member is in the second position.

6. The dart storage rack of claim 1 wherein the one or more dart storage magnets are secured within the one or more apertures with an adhesive.

7. The dart storage rack of claim 1 wherein the one or more dart storage magnets are tension fit within the one or more apertures.

8. The dart storage rack of claim 1 wherein the one or more dart storage magnets are cylindrical.

9. The dart storage rack of claim 1 wherein the one or more darts can be simultaneously stored within the storage holes disposed within the top wall, and secured to the storage magnets disposed within the bottom wall when the base member is in the first position.

* * * * *